US010377143B2

(12) United States Patent
Hara

(10) Patent No.: US 10,377,143 B2
(45) Date of Patent: Aug. 13, 2019

(54) CIRCULATOR AND LIQUID EJECTOR

(71) Applicant: TOSHIBA TEC KABUSHIKI KAISHA, Tokyo (JP)

(72) Inventor: Kazuhiro Hara, Numazu Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/876,849

(22) Filed: Jan. 22, 2018

(65) Prior Publication Data

US 2018/0257384 A1 Sep. 13, 2018

(30) Foreign Application Priority Data

Mar. 8, 2017 (JP) ..... 2017-043657

(51) Int. Cl.
*B41J 2/18* (2006.01)
*B41J 2/175* (2006.01)

(52) U.S. Cl.
CPC ..... *B41J 2/17556* (2013.01); *B41J 2/175* (2013.01); *B41J 2/17506* (2013.01); *B41J 2/18* (2013.01)

(58) Field of Classification Search
CPC . B41J 2/17556; B41J 2/175; B41J 2/18; B41J 2/17506
See application file for complete search history.

(56) References Cited

U.S. PATENT DOCUMENTS

| | | | |
|---|---|---|---|
| 8,132,901 | B2 | 3/2012 | Bansyo |
| 2010/0073437 | A1 | 3/2010 | Shibata et al. |
| 2010/0079562 | A1 | 4/2010 | Katada et al. |
| 2010/0085396 | A1 | 4/2010 | Yokota et al. |
| 2016/0288523 | A1 | 10/2016 | Ohtsu et al. |

OTHER PUBLICATIONS

Ip.com search (Year: 2019).*
U.S. Appl. No. 15/682,936, filed Aug. 22, 2017 (First Inventor: Kazuhiro Hara).
Extended European Search Report dated Jul. 24, 2018, filed in counterpart European Patent Application No. 18157318.9 (10 pages).

* cited by examiner

*Primary Examiner* — Lisa Solomon
(74) *Attorney, Agent, or Firm* — Kim & Stewart LLP

(57) ABSTRACT

A liquid circulator includes an upstream tank having a first pressure sensor, an intermediate tank, a downstream tank having a second pressure sensor, a circulation route for circulating liquid through an liquid ejecting head, the downstream tank, the intermediate tank, and the upstream tank, a first pump on the circulation route between the intermediate tank and the upstream tank, a second pump on the circulation route between the downstream tank and the intermediate tank, a first drive circuit configured to apply a first driving pulse to the first pump, a second drive circuit configured to apply a second driving pulse to the second pump, a controlling unit configured to calculate a pressure fluctuation value of the circulation route based on pressure values measured by the first and second pressure sensors, and adjust a phase difference between the first and second driving pulses as to minimize the pressure fluctuation value.

17 Claims, 9 Drawing Sheets

CIRCULATOR AND LIQUID EJECTOR

CROSS-REFERENCE TO RELATED APPLICATION

This application is based upon and claims the benefit of priority from Japanese Patent Application No. 2017-043657, filed Mar. 8, 2017, the entire contents of which are incorporated herein by reference.

FIELD

Embodiments described herein relate generally to a circulator and a liquid ejector.

BACKGROUND

Liquid ejectors known in the art include a liquid ejecting head for ejecting liquid and a liquid circulator for circulating liquid through a circulation route. Such a liquid ejector controls pumps to adjust the pressure of the liquid in the circulation route. However, in a liquid ejector having multiple pumps, driving pulses generated for these pumps may undesirably fluctuate and thus cause the pressure of the liquid in the circulation route to vary.

DETAILED DESCRIPTION

In general, according to one embodiment, a liquid circulator includes an upstream tank having a first pressure sensor, an intermediate tank, a downstream tank having a second pressure sensor, a circulation route for circulating liquid through a liquid ejecting head, the downstream tank, the intermediate tank, and the upstream tank, a first pump on the circulation route between the intermediate tank and the upstream tank, a second pump on the circulation route between the downstream tank and the intermediate tank, a first drive circuit configured to apply a first driving pulse to the first pump, a second drive circuit configured to apply a second driving pulse to the second pump, a controlling unit configured to calculate a pressure fluctuation value of the circulation route based on pressure values measured by the first pressure sensor and the second pressure sensor, and adjust a phase difference between the first driving pulse and the second driving pulse as to minimize the pressure fluctuation value.

Figure 1:
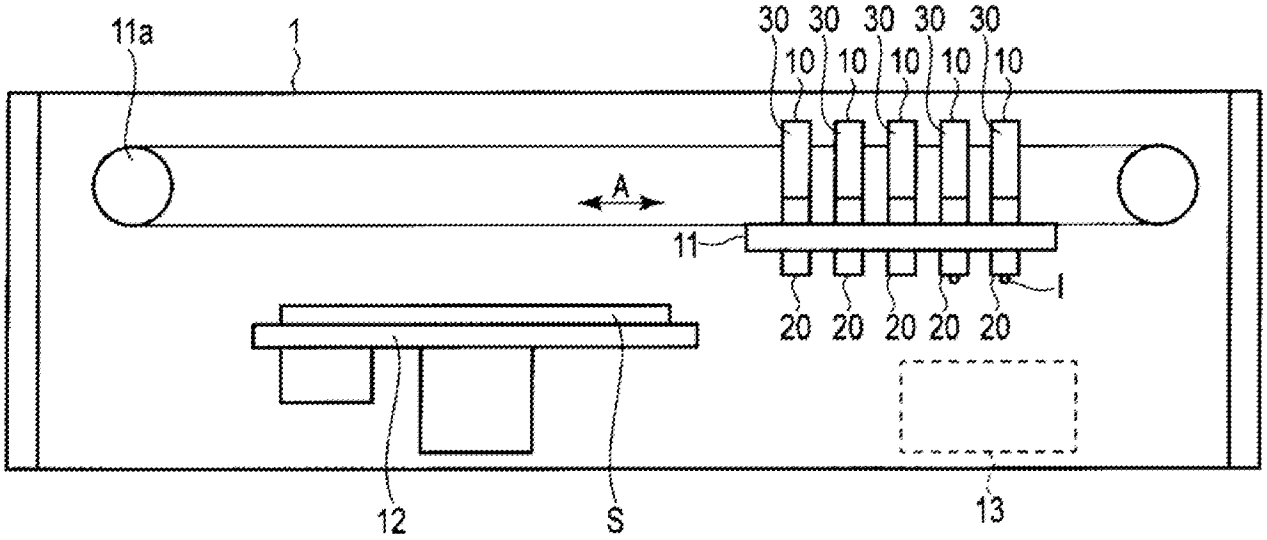
FIG. 1 is a side view of an ink jet recorder according to one embodiment.
Figure 2:
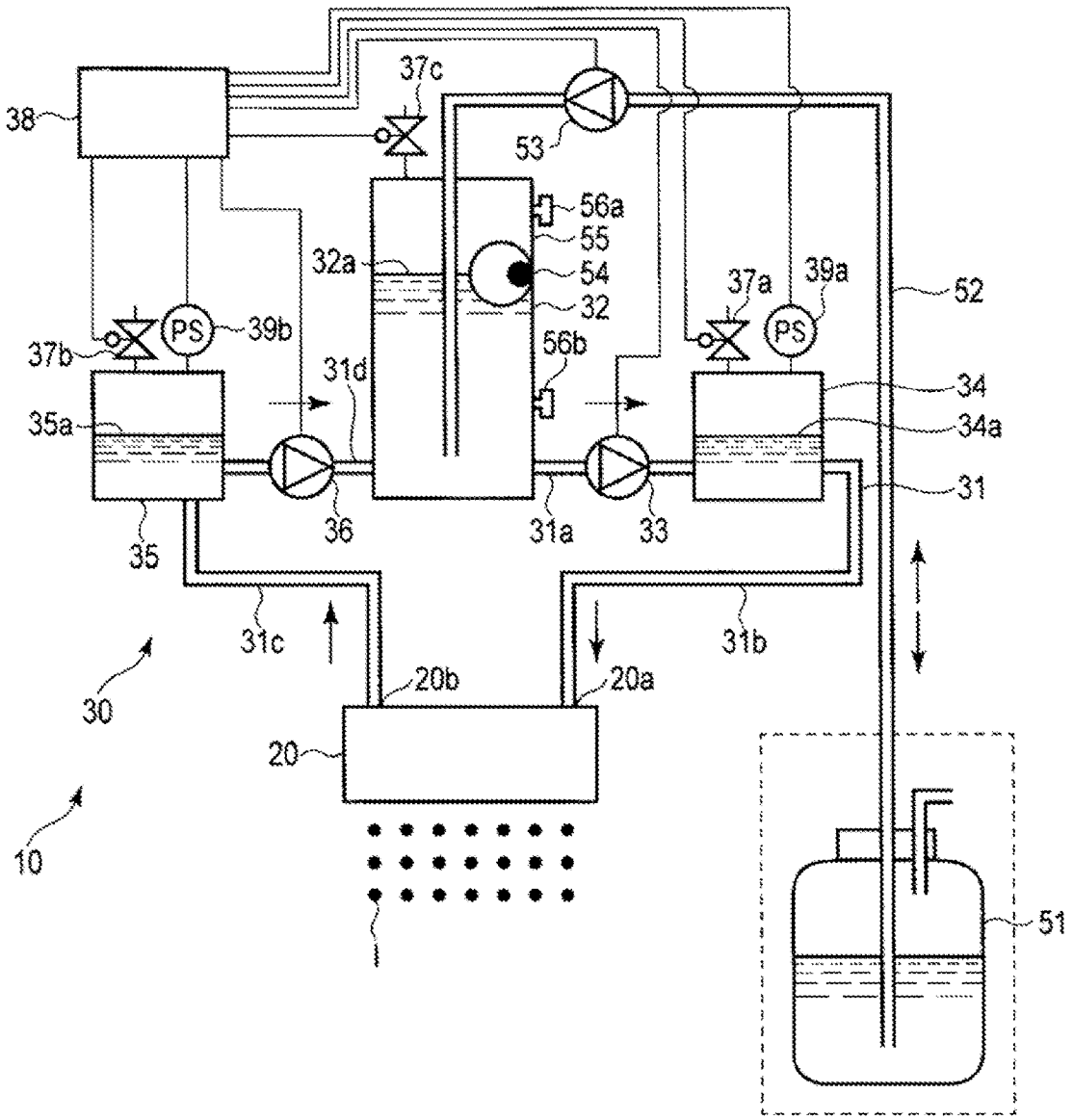
FIG. 2 is a diagram of a liquid ejector according to the embodiment.
Figure 3:
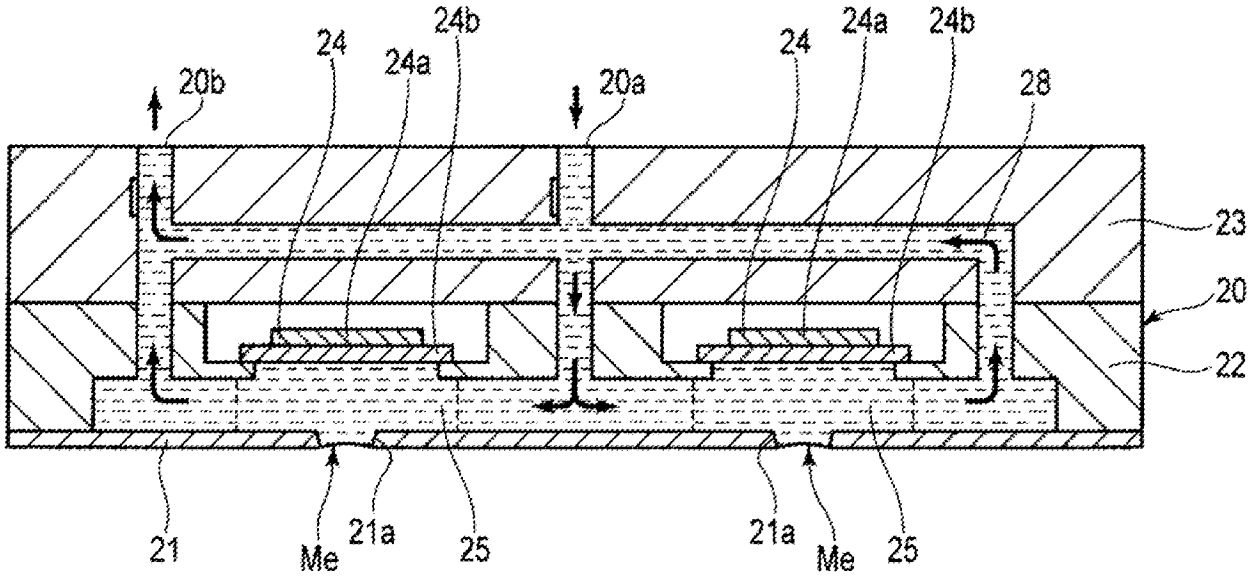
FIG. 3 is a diagram of a liquid ejecting head of a liquid ejector.
Figure 4:
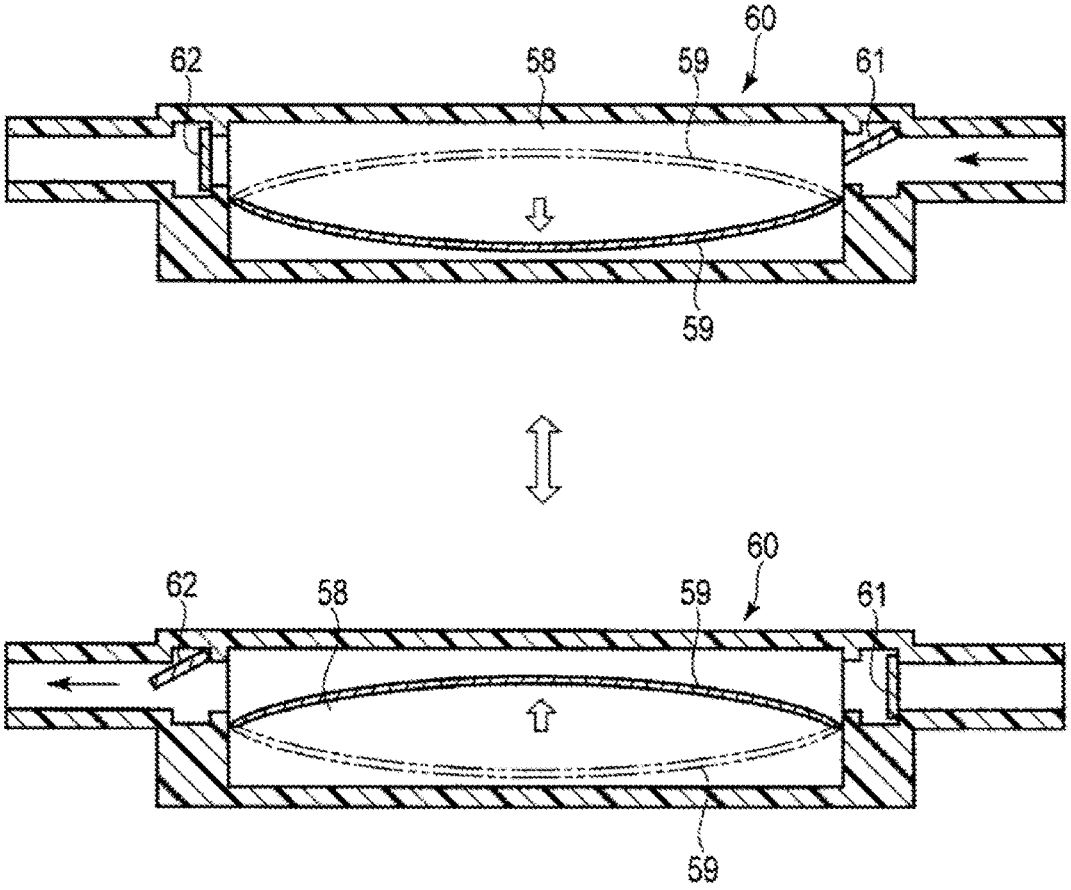
FIG. 4 is a diagram of a piezoelectric pump of a liquid ejector.
Figure 5:
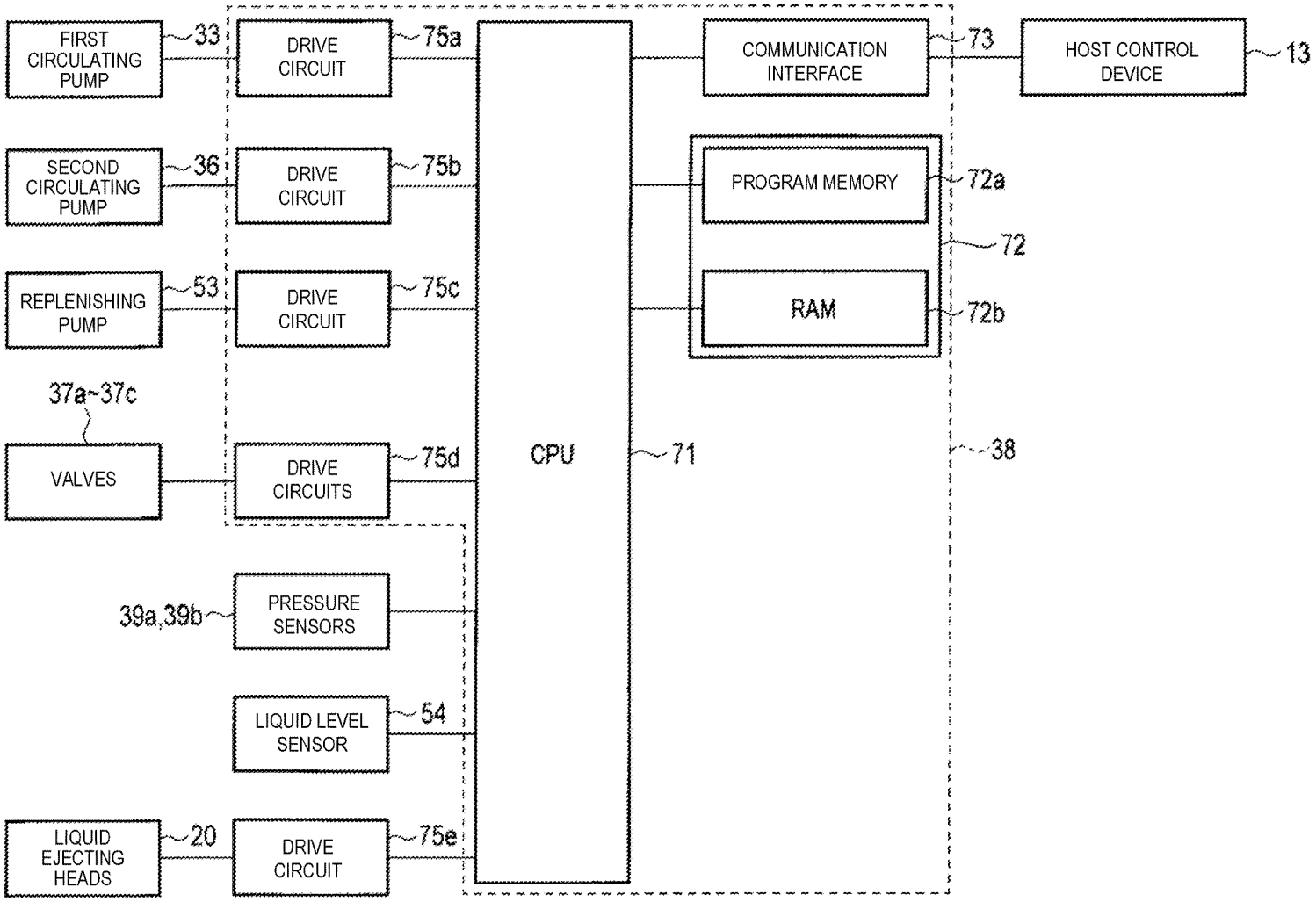
FIG. 5 is a block diagram of a module controlling unit in the liquid ejector and units connected to the module controlling unit.

Hereinafter, a liquid ejector 10 according to an embodiment and an ink jet recorder 1 including the liquid ejector 10 will be described with reference to FIGS. 1 to 5. For convenience of explanation, the structure may not be shown to scale in the drawings. FIG. 1 is a side view of the ink jet recorder 1. FIG. 2 is a diagram of the liquid ejector 10. FIG. 3 is a diagram of a liquid ejecting head 20. FIG. 4 is a diagram of a first circulating pump 33, a second circulating pump 36, or a replenishing pump 53. FIG. 5 is a block diagram of a module controlling unit 38 in the liquid ejector 10 and units connected to the module controlling unit 38.

The ink jet recorder 1 shown in FIG. 1 includes liquid ejectors 10, a head supporting mechanism 11 for movably supporting the liquid ejectors 10, a medium supporting mechanism 12 for movably supporting a recording medium S, and a host control device 13. The inkjet recorder 1 is an example of a liquid ejecting apparatus.

As shown in FIG. 1, the liquid ejectors 10 arranged in parallel in a predetermined direction are supported by the head supporting mechanism 11. The liquid ejectors 10 each integrally include a liquid ejecting head 20 and a circulator 30. The liquid ejectors 10 each eject a liquid, such as ink I, from the corresponding liquid ejecting heads 20 to the recording medium S to generate a desired image.

The liquid ejectors 10 each eject ink of a color, for example, a cyan ink, a magenta ink, a yellow ink, a black ink, or a white ink. The color and the types of the ink I are not limited. For example, instead of the white ink, a transparent glossy ink or a special ink that develops color under infrared irradiation or ultraviolet irradiation can be ejected. The liquid ejectors 10 may eject different inks from each other, but they have configurations similar to each other.

The liquid ejecting head 20 shown in FIG. 3 is an ink jet head and includes a nozzle plate 21 having nozzle holes 21*a*, a board 22, and a manifold 23 bonded to the board 22. The opposite side of the board 22 faces the nozzle plate 21 and the board 22 is formed in a shape so as to form a ink channel 28 having ink pressurizing chambers 25 between the board 22 and the nozzle plate 21. The board 22 includes an actuator 24 at a part facing the ink pressurizing chamber 25. The board 22 includes a partition wall between the two adjacent ink pressurizing chambers 25 aligned in a same row. The actuator is disposed facing the nozzle hole 21*a*, and the ink pressurizing chamber 25 is formed between the actuator 24 and the nozzle hole 21*a*.

The liquid ejecting head 20 has the ink channel 28 enclosed by the nozzle plate 21, the board 22, and the manifold 23 so as to have the ink pressurizing chambers 25 inside of the ink channel 28. The board 22 includes the actuator 24 having electrodes 24*a* and 24*b*, at a part facing the ink pressurizing chamber 25. The actuators 24 are connected to a drive circuit. The liquid ejecting head 20 ejects liquid from the nozzle holes 21*a*, which are arranged facing the respective actuators 24, due to bending of the actuators 24 in accordance with voltage controlled by a module controlling unit 38. The liquid ejecting head 20 is an example of an ejecting unit for ejecting liquid.

As shown in FIG. 2, the circulator 30 is integrally connected to an upper part of the liquid ejecting head 20 by metal or other material. The circulator 30 includes a circulation route 31, an intermediate tank 32, a first circulating pump 33, an upstream tank 34 (first tank), a downstream tank 35 (second tank), a second circulating pump 36, on-off valves 37*a*, 37*b*, and 37*c*, and the module controlling unit 38.

The circulator 30 also includes a cartridge 51, a supply route 52, and a replenishing pump 53 outside of the circulation route 31.

The cartridge 51 is a tank for holding ink to be supplied to the intermediate tank 32. The cartridge 51 contains an air chamber inside, which is open to the atmosphere.

The supply route 52 is a channel that connects the intermediate tank 32 and the cartridge 51.

The replenishing pump 53 is provided on the supply route 52 and sends ink in the cartridge 51 to the intermediate tank 32.

The circulation route 31 includes a first channel 31*a*, a second channel 31*b*, a third channel 31*c*, and a fourth channel 31*d*.

The first channel 31*a* connects the intermediate tank 32 and the first circulating pump 33. The second channel 31*b* connects the first circulating pump 33 and a supply port 20*a* of the liquid ejecting head 20. The third channel 31*a* connects a recovery port 20*b* of the liquid ejecting head 20 and the second circulating pump 36. The fourth channel 31*d* connects the second circulating pump 36 and the intermediate tank 32. Thus, the circulation route 31 extends from the intermediate tank 32 to the supply port 20*a* of the liquid ejecting head 20 through the first channel 31*a* and the second channel 31*b*, and returns from the recovery port 20*b* of the liquid ejecting head 20 to the intermediate tank 32 through the third channel 31*c* and the fourth channel 31*d*.

The first to the fourth channels 31*a* to 31*d* and the supply route 52 include, for example, pipes and tubes. The pipes are made of metal, resin material, or other material. The tubes cover the outer surfaces of the pipes. The tubes are, for example, Polytetrafluoroethylene (PTFE) tubes.

The intermediate tank 32 is connected to the liquid ejecting head 20 by the circulation route 31 and is capable of storing liquid. The intermediate tank 32 has an on-off valve 37*c* for allowing an air chamber inside the intermediate tank 32 to be open to the atmosphere. The intermediate tank 32 also has a liquid level sensor 54 for measuring the height of a liquid surface 32*a* of the liquid stored in the intermediate tank 32.

The upstream tank 34 is disposed upstream of the liquid ejecting head 20 and is capable of storing the liquid. The upstream tank 34 is disposed on the second channel 31*b* of the circulation route 31. The upstream tank 34 has a diaphragm 34*a* made of, for example, polyimide or PTFE, which is formed at the height of a liquid surface to prevent air babbles from generating in the liquid. The diaphragm 34*a* is elastic and deforms in accordance with pressure of the liquid in the upstream tank 34. Thus, an air chamber inside the upstream tank 34 is pressurized due to the deformation of the diaphragm 34*a*. That is, the pressure in the air chamber inside the upstream tank 34 fluctuates in accordance with the pressure of the liquid in the upstream tank 34. The upstream tank 34 includes a first pressure sensor 39*a* that functions as a first pressure measuring unit.

The downstream tank 35 is disposed downstream of the liquid ejecting head 20 and is capable of storing the liquid. The downstream tank 35 is provided on the third channel 31*c* of the circulation route 31. The downstream tank 35 has a diaphragm 35*a* made of, for example, polyimide or PTFE, which is formed at the height of a liquid surface to prevent air babbles from generating in the liquid. The diaphragm 35*a* is elastic and deforms in accordance with pressure of the liquid in the downstream tank 35. Thus, an air chamber inside the downstream tank 35 is pressurized due to the deformation of the diaphragm 35*a*. That is, the pressure in the air chamber inside the downstream tank 35 fluctuates in accordance with the pressure of the liquid in the downstream tank 35. The downstream tank 35 includes a second pressure sensor 39*b* that functions as a second pressure measuring unit.

The first pressure sensor 39*a* measures the pressure in the air chamber inside the upstream tank 34 and sends the measurement data to the module controlling unit 38. The diaphragm 34*a* causes a pressure change in the air chamber inside the upstream tank 34 to fluctuate in accordance with a pressure change in the liquid in the upstream tank 34. Thus, the circulator 30 indirectly measures the pressure change in the liquid in the upstream tank 34, that is, the pressure change in the liquid in the second channel 31*b*, by measuring the pressure in the air chamber inside the upstream tank 34.

The second pressure sensor 39*b* measures the pressure in the air chamber inside the downstream tank 35 and sends the measurement data to the module controlling unit 38. The diaphragm 35*a* causes a pressure change in the air chamber inside the downstream tank 35 to fluctuate in accordance with a pressure change in the liquid in the upstream tank 35. Thus, the circulator 30 indirectly measures the pressure change in the liquid in the downstream tank 35, that is, the pressure change in the liquid in the third channel 31*c*, by measuring the pressure in the air chamber inside the downstream tank 35.

Each of the first pressure sensor 39*a* and the second pressure sensor 39*b* measures pressure by using, for example, a semiconductor piezoresistance pressure sensor, and outputs the result as an electric signal. The semiconductor piezoresistance pressure sensor includes a diaphragm for receiving pressure from the outside and a semiconductor strain gage formed on the surface of the diaphragm. The semiconductor piezoresistance pressure sensor measures pressure by converting fluctuations in electric resistance into an electric signal. The fluctuations in the electric resistance occur due to a piezoresistance effect that is generated in the strain gage in accordance with deformation of the diaphragm when pressure is applied to the diaphragm from the outside.

The liquid level sensor 54 includes a float 55 that floats vertically on the liquid surface and Hall ICs 56*a* and 56*b* that are respectively provided at upper and lower predetermined positions. The liquid level sensor 54 detects that the float 55 has reached an upper limit position or a lower limit position by using the Hall IC 56*a* or 56*b* to measure the amount of the ink in the intermediate tank 32 and sends the measurement data to the module controlling unit 38.

The on-off valve 37*a* is provided to the upstream tank 34. The on-off valve 37*b* is provided to the downstream tank 35. The on-off valves 37*a* and 37*b* are, for example, normally closed solenoid on-off valves that open when energized and that close when unenergized. The on-off valve 37*a* is controlled to open or close by the module controlling unit 38 to allow the air chamber inside the upstream tank 34 to open to or be shut off from the atmosphere. The on-off valve 37*b* is controlled to open or close by the module controlling unit 38 to allow the air chamber inside the downstream tank 35 to open to or be shut off from the atmosphere. The on-off valves 37*a* and 37*b* are normally closed during circulation operation. The on-off valve 37*a* is opened such as when the first pressure sensor 39*a* is calibrated. The on-off valve 37*b* is opened such as when the second pressure sensor 39*b* is calibrated.

The on-off valve 37*c* is provided to the intermediate tank 32. The on-off valve 37*c* is, for example, a normally closed solenoid on-off valve that opens when energized and that closes when unenergized. The on-off valve 37*c* is controlled to open or close by the module controlling unit 38 to allow the air chamber inside the intermediate tank 32 to open to or be shut off from the atmosphere.

The first circulating pump 33 is provided between the first channel 31*a* and the second channel 31*b* of the circulation route 31. The first circulating pump 33 is disposed upstream of the upstream tank 34 between the supply port 20*a* of the liquid ejecting head 20 and the intermediate tank 32. The first circulating pump 33 sends the liquid to the liquid ejecting head 20 disposed downstream of the first circulating pump 33.

The second circulating pump 36 is provided between the third channel 31*c* and the fourth channel 31*d* of the circulation route 31. The second circulating pump 36 is disposed downstream of the downstream tank 35 between the recovery port 20*b* of the liquid ejecting head 20 and the intermediate tank 32. The second circulating pump 36 sends the liquid to the intermediate tank 32 disposed downstream of the second circulating pump 36.

The first circulating pump 33 is an example of a first pump, and the second circulating pump 36 is an example of a second pump. Alternatively, the first circulating pump 33 is an example of a second pump, and the second circulating pump 36 is an example of a first pump.

The replenishing pump 53 is provided in the supply route 52. The replenishing pump 53 sends the ink I held in the cartridge 51 to the intermediate tank 32.

Each of the first circulating pump 33, the second circulating pump 36, and the replenishing pump 53 is, for example, formed by a piezoelectric pump 60 as shown in FIG. 4. The piezoelectric pump 60 includes a pump chamber 58, a piezoelectric actuator 59, and check valves 61 and 62. The piezoelectric actuator 59 is provided in the pump chamber 58. The piezoelectric actuator 59 vibrates when applied with voltage. The piezoelectric actuator 59 is vibratable at a frequency of, for example, approximately 50 to 200 Hz. The check valve 61 is disposed at an inlet of the pump chamber 58. The check valve 62 is disposed at an outlet of the pump chamber 58. The first circulating pump 33, the second circulating pump 36, and the replenishing pump 53 are controllable by the module controlling unit 38, which is connected to their respective drive circuits with wiring. When applied with AC voltage, the piezoelectric pump 60 operates the piezoelectric actuator 59 to change the volume of the pump chamber 58. As the voltage applied to the piezoelectric pump 60 changes, the maximum change amount of the piezoelectric actuator 59 also changes, and the volume change of the pump chamber 58 changes accordingly. In response to the deformation of the pump chamber 58 increasing the volume, the check valve 61 at the inlet of the pump chamber 58 opens to allow the ink to flow into the pump chamber 58. Conversely, in response to the deformation of the pump chamber 58 decreasing the volume, the check valve 62 at the outlet of the pump chamber 58 opens to allow the ink to flow out from the pump chamber 58. The piezoelectric pump 60 sends the ink I to the downstream by causing the pump chamber 58 expand and contract repeatedly. Thus, a large voltage that is applied to the piezoelectric actuator 59 provides a large capacity to send the ink I, whereas a small voltage that is applied to the piezoelectric actuator 59 provides a small capacity to send the ink I. For example, the voltage to be applied to the piezoelectric actuator 59 is changed in a range of 50 to 150 V.

As shown in FIG. 5, the module controlling unit 38 includes, for example, a central processing unit (CPU) 71, drive circuits 75*a* to 75*d* for driving respective components, a storage 72, and a communication interface 73, on a control board that is integrated on the circulator 30.

The module controlling unit 38 receives various information, such as operating condition, through the communication interface 73 by communicating with the connected host control device 13 that is provided outside the module controlling unit 38.

An input operation from a user and an instruction from the host control device 13 of the ink jet recorder 1 are sent to the CPU 71 of the module controlling unit 38 through the communication interface 73. The various information obtained by the module controlling unit 38 is sent to a PC application or the host control device 13 of the inkjet recorder 1 through the communication interface 73.

The CPU 71 corresponds to a center part of the module controlling unit 38. The CPU 71 also corresponds to a center part of a computer that executes processing and controlling, which are necessary for operating the circulator 30. The CPU 71 controls each component in accordance with programs of an operating system or of application software stored in the storage 72 or other storage means, to cause the liquid ejector 10 perform each function.

The CPU 71 is connected to the drive circuit of each pump of the circulator 30, that is, the drive circuit 75*a* of the first circulating pump 33, the drive circuit 75*b* of the second circulating pump 36, and the drive circuit 75*c* of the replenishing pump 53. The CPU 71 is also connected to the drive circuit 75*d* of each of the on-off valves 37*a* to 37*c* and to a drive circuit 75*e* of the liquid ejecting heads 20. The CPU 71 is further connected to each sensor, that is, the first pressure sensor 39*a*, the second pressure sensor 39*b*, and the liquid level sensor 54.

The CPU 71 controls to drive the first circulating pump 33 and the second circulating pump 36 to cause the ink I circulate through the circulation route 31.

The storage 72 stores various data. The storage 72 includes, for example, a program memory 72*a* and a random-access memory (RAM) 72*b*.

The program memory 72*a* is a nonvolatile memory corresponding to a main storage part of the computer. The program memory 72*a* stores programs such as an operating system and application software. The program memory 72*a* also stores data and various set values that are used for executing various processing by the CPU 71. The program memory 72*a* stores control data used for controlling pressure, for example, a formula for calculating ink pressure at the nozzle holes 21*a*, a target pressure range, and various set values such as a maximum adjustable value of each pump. The program memory 72*a* also stores a pitch width dt and a repetition number k. The pitch width dt and the repetition number k are determined by a designer or an administrator of the ink jet recorder 1 in advance. The functions of the pitch width dt and the repetition number k will be described later.

The programs stored in the program memory 72*a* or other storage means include a control program describing control processing. In one case, the circulator 30 is transferred to a user or other recipient in a condition in which the control program is stored in the program memory 72*a*. However, the circulator 30 may be transferred to a user or other recipient in a condition in which the control program describing the control processing is not stored in the program memory 72*a*. In another case, the circulator 30 may be transferred to a user or other recipient in a condition in which another control program is stored in the program memory 77*a*. In this case, the control program describing the control processing is transferred to the user or the recipient separately from the circulator 30, and this control program may be written in the program memory 72*a* by the user or a service person. The control program can be transferred, for example, stored in a removable storage medium, such as a magnetic disk, an optical magnetic disk, an optical disk, or a semiconductor memory, or downloaded through a network.

The RAM 77*b* is a volatile memory corresponding to the main storage part of the computer. The RAM 77*b* functions as a work area, which temporarily stores data that is used for executing various processing by the CPU 71.

Figure 6:
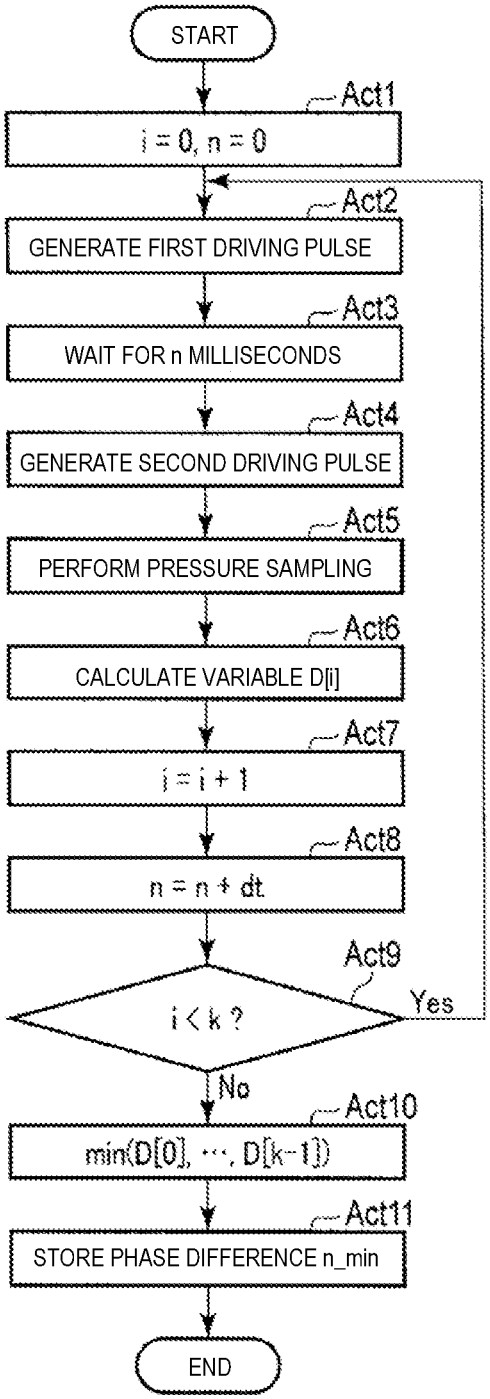
FIG. 6 is a flow chart of a method for controlling a liquid ejector.
Figure 7:
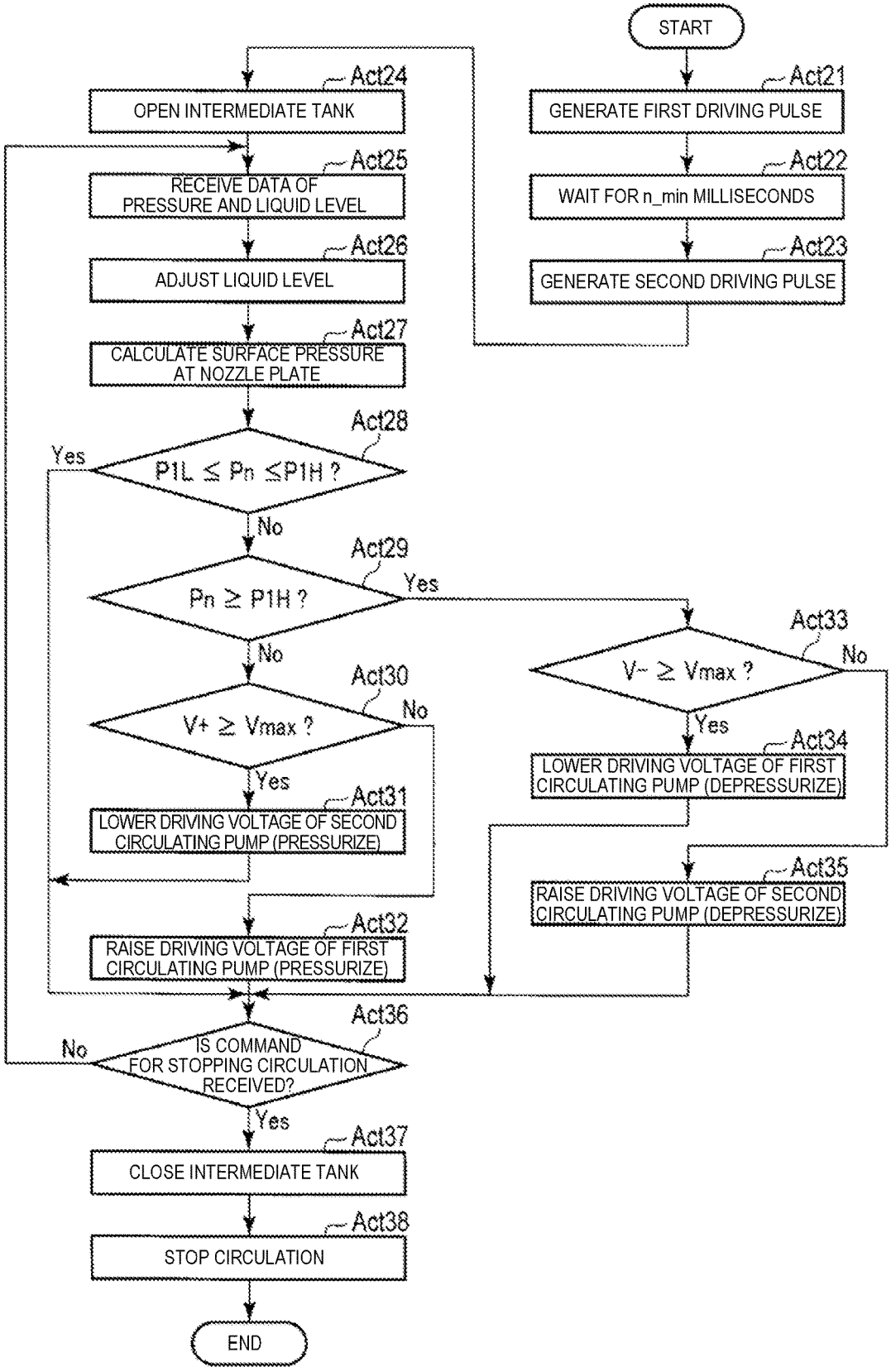
FIG. 7 is a flow chart of a method for controlling a liquid ejector.

Hereinafter, a liquid ejecting method of the liquid ejector 10 and operation of the liquid ejector 10 according to the embodiment will be described with reference to the flow charts shown in FIGS. 6 and 7. FIGS. 6 and 7 are flow charts for the control processing executed by the CPU 71 of the circulator 30. The CPU 71 executes the control processing in accordance with the control program stored in the program memory 72*a* or other storage means.

The CPU 71 starts the control processing as shown in FIG. 6 at an initial start, for example, after shipped from a factory. The CPU 71 also starts the control processing as shown in FIG. 6 to execute a maintenance operation, such as calibration of the pressure sensor. The CPU 71 also starts the control processing as shown in FIG. 6 in response to an instruction from an operator. When the control processing as shown in FIG. 6 is started, the circulator 30 starts to operate in a mode for determining an optimum phase difference (hereinafter referred to as a "phase difference determination mode"). The phase difference is a difference between the phase of a driving pulse of the first circulating pump 33 (hereinafter referred to as a "first driving pulse") and the phase of a driving pulse of the second circulating pump 36 (hereinafter referred to as a "second driving pulse").

The CPU 71 allocates a data array D including one or more variables, for example, a variable n, and a variable i, to the RAM 77*b*, when starting the control processing as shown in FIG. 6.

The CPU 71 initializes the variables in Act 1 shown in FIG. 6. Specifically, the CPU 71 sets the values of the variables i and n to zero. After performing the processing in Act 1, the CPU 71 advances the processing to Act 2.

The CPU 71 generates a driving pulse of the first circulating pump 33 in Act 2. In the case that the first driving pulse is already generated, the CPU 71 resets the first driving pulse. After performing the processing in Act 2, the CPU 71 advances the processing to Act 3.

The CPU 71 waits for n milliseconds in Act 3. After performing the processing in Act 3, the CPU 71 advances the processing to Act 4.

The CPU 71 generates a driving pulse of the second circulating pump 36 in Act 4. In the case that the second driving pulse is already generated, the CPU 71 resets the second driving pulse. The processing from Act 2 to Act 4 allows generation of the second driving pulse in n milliseconds after the first driving pulse is generated. After performing the processing in Act 4, the CPU 71 advances the processing to Act 5.

The CPU 71 performs pressure sampling in Act 5. The pressure sampling is performed to measure ink pressure at the nozzle holes 21*a* of the liquid ejecting head 20 at a predetermined time interval, for example. The CPU 71 measures the pressure by using the first pressure sensor 39*a* and the second pressure sensor 39*b*, for example. Alternatively, the liquid ejecting head 20 may be provided with a sensor for measuring the ink pressure at the nozzle holes 21*a*. In this case, the CPU 71 may use the sensor provided to the liquid ejecting head 20 in measurement of the ink pressure at the nozzle holes 21*a*. After performing the processing in Act 5, the CPU 71 advances the processing to Act 6.

The CPU 71 calculates a fluctuation value that represents the range of fluctuations in the ink pressure in the circulation route 31 from the result of the pressure sampling in Act 5. The CPU 71 substitutes the calculated fluctuation value in a variable D[i]. The variable D[i] represents a (i+1)th variable in the data array D. The CPU 71 calculates the fluctuation value by, for example, using one of the following methods (1) to (3).

(1) Select the highest pressure value and the lowest pressure value among the measured pressure values, and use a difference between the lowest pressure value and the highest pressure value as the fluctuation value. That is, a range between the highest and lowest pressure values is used as the fluctuation value. An interquartile range may also be used as the fluctuation value.

(2) Calculate an average value of the measured pressure values. Then, calculate a square of the difference between each of the measured pressure values and the average value. Thereafter, calculate an average value of the squared values, and use this average value or a square root of this average value as the fluctuation value. That is, a variance ora standard deviation is used as the fluctuation value.

(3) Calculate an average value of the measured pressure values. Then, calculate an absolute value of the difference between each of the measured pressure values and the average value. Thereafter, calculate an average value of the absolute values, and use this average value as the fluctuation value. That is, an average deviation is used as the fluctuation value.

These are examples for calculating the fluctuation value, and other methods can also be used.

After performing the processing in Act 6, the CPU 71 advances the processing to Act 7.

The CPU 71 increases the value of the variable i by 1 in Act 7. After performing the processing in Act 7, the CPU 71 advances the processing to Act 8.

The CPU 71 increases the value of the variable n by the pitch width dt in Act 8. After performing the processing in Act 8, the CPU 71 advances the processing to Act 9.

The CPU 71 determines whether the value of the variable i is less than the repetition number k in Act 9. The CPU 71 determines Yes in Act 9 when the value of the variable i is less than the repetition number k, and the CPU 71 returns the processing to Act 2. Thus, the CPU 71 repeats the processing from Act 2 to Act 9 until the value of the variable i becomes the repetition number k or greater, that is, k times.

The CPU 71 determines No in Act 9 when the value of the variable i is the repetition number k or greater, and the CPU 71 advances the processing to Act 10.

The CPU 71 selects the minimum value D[i_min] from among the values of D[0] to D[k−1] in Act 10. After performing the processing in Act 10, the CPU 71 advances the processing to Act 11.

The CPU 71 calculates the value of the variable n when i=i_min, that is, a phase difference n_min in Act 11. The CPU 71 stores the phase difference n_min in the storage 72 or other storage means. The phase difference n_min is calculated such that, for example, n_min=dt×i_min. Alternatively, the CPU 71 may store a variable n [i] by using the variable array n instead of the variable n. In this case, n_min=n[i_min]. After performing the processing in Act 11, the CPU 71 finishes the control processing as shown in FIG. 6. That is, the CPU 71 finishes the operation in the phase difference determination mode. The phase difference n_min is an example of a predetermined phase difference. Thus, the computer having the CPU 71 as its center part performs the processing as shown in FIG. 6 as a controlling unit that sets a phase difference corresponding to the minimum fluctuation value as a predetermined phase difference.

The CPU 71 waits for an instruction to start the circulation. For example, after being instructed to start the circulation by a command from the host control device 13, the CPU 71 starts the control processing as shown in FIG. 7. In printing operation, the host control device 13 causes the liquid ejectors 10 eject ink while reciprocating in a direction orthogonal to a feeding direction of the recording medium S to generate an image on the recording medium S. Specifically, the CPU 71 drives a roller 11*a* to send the head supporting mechanism 11 toward the recording medium S and to cause the head supporting mechanism 11 reciprocate in the direction indicated by the arrow A in FIG. 1. The CPU 71 sends an image signal corresponding to image data to the drive circuit 75*e* of the liquid ejecting heads 20 and selectively drives the actuators 24 of the liquid ejecting heads 20 to allow ink droplets ID to be ejected from the nozzle holes 21*a* to the recording medium S.

The CPU 71 reads the phase difference n_min, which is stored in the storage 72 in the phase difference determination mode, at the start of the control processing as shown in FIG. 7.

The CPU 71 generates the first driving pulse in Act 21 shown in FIG. 7. In response to this first driving pulse, the first circulating pump 33 starts driving. After performing the processing in Act 21, the CPU 71 advances the processing to Act 22.

The CPU 71 waits for n_min milliseconds in Act 22. After performing the processing in Act 22, the CPU 71 advances the processing to Act 23.

The CPU 71 generates the second driving pulse in Act 23. Thus, the second circulating pump 36 starts driving in n_min milliseconds after the first circulating pump 33 starts driving. Performing the processing from Act 21 to Act 23 allows the first circulating pump 33 and the second circulating pump 36 to start driving, thereby starting the circulation of the ink I. The ink I flows out from the intermediate tank 32 into the liquid ejecting head 20 through the upstream tank 34 and then returns into the intermediate tank 32 through the downstream tank 35. During this circulation operation, impurities that may be contained in the ink I are removed by a filter provided in the circulation route 31. The first and the second driving pulses are examples of first and second driving voltages. Thus, the computer having the CPU 71 as its center part performs the processing from Act 21 to Act 23 as a controlling unit that applies the first and the second driving voltages, which have a predetermined phase difference therebetween, to the first and the second pumps. The first circulating pump 33 and the second circulating pump 36 that start driving operate as circulating units that allow the liquid to circulate through the circulation route 31. After performing the processing in Act 23, the CPU 71 advances the processing to Act 24.

The CPU 71 opens the on-off valve 37*c* of the intermediate tank 32 to open the air chamber of the intermediate tank 32 to the atmosphere in Act 24. Since the air chamber of the intermediate tank 32 open to the atmosphere has a pressure equal to the atmospheric pressure, the pressure in the circulation route 31 is prevented from being decreased by the ink consumption at the liquid ejecting head 20. If an opening of the on-off valve 37*c* for a prolonged time may cause a temperature rise in the on-off valve 37*c*, the on-off valve 37*c* may be opened intermittently. Unless the pressure in the circulation route 31 is excessively decreased, the ink pressure at the nozzle holes 21*a* is maintained constant without opening the on-off valve 37*c*. The on-off valve 37*c* is a solenoid type valve that is normally closed. Thus, even when the power supply is suddenly stopped due to power failure or the like, the on-off valve 37*c* closes instantaneously to shut off the intermediate tank 32 from the atmosphere and thereby tightly close the circulation route 31. This structure prevents the ink I from dripping from the nozzle holes 21*a* of the liquid ejecting head 20.

The CPU 71 receives pressure data of the upstream side sent from the first pressure sensor 39*a* in Act 25. The CPU 71 also receives pressure data of the downstream side sent from the second pressure sensor 39*b*. Moreover, the CPU 71 obtains a liquid level of the intermediate tank 32 by referring to data sent from the liquid level sensor 54.

The CPU 71 starts adjusting the liquid level in Act 26. Specifically, the CPU 71 drives the replenishing pump 53 in accordance with the result measured by the liquid level sensor 54 to replenish the ink from the cartridge 51 and thus adjusts the position of the liquid surface in an appropriate range. For example, when the amount of the ink in the intermediate tank 32 is instantaneously decreased by injecting the ink droplets ID from the nozzle holes 21*a* in printing, and thus, the liquid surface is lowered, the ink is replenished. After the amount of the ink is increased, and thereby the output of the liquid level sensor 54 is inverted, the CPU 71 stops the replenishing pump 53.

The CPU 71 obtains the ink pressure at the nozzle holes 21*a* from the pressure data in Act 27. Specifically, the CPU 71 calculates the ink pressure at the nozzle holes 21*a* from the pressure data of the upstream side sent from the first pressure sensor 39*a* and the pressure data of the downstream side sent from the second pressure sensor 39*b* by using a specific formula.

For example, a pressure value PH of the air chamber of the upstream tank 34 and a pressure value PL of the air chamber of the downstream tank 35*a* are averaged, and a value of a pressure ρgh that occurs due to a water head difference between the liquid surface height in the upstream tank 34 or the downstream tank 35 and the surface height of the nozzle plate 21 is added to the average value, whereby a value of an ink pressure Pn at the nozzle holes 21*a* is obtained. Here, the symbol ρ represents density of the ink, the symbol g represents gravitational acceleration, and the symbol h represents the distance between the liquid surface height in the upstream tank 34 or the downstream tank 35 and the surface height of the nozzle plate 21. The liquid surface heights in the upstream tank 34 and the downstream tank 35 respectively correspond to the heights of the diaphragms 34*a* and 35*a*, and the diaphragms 34*a* and 35*a* are set at the same height.

The CPU 71 performs pressure adjusting processing by calculating a driving voltage in accordance with the ink pressure Pn at the nozzle holes 21*a*, which is calculated from the pressure data. Then, the CPU 71 drives the first circulating pump 33 and the second circulating pump 36 with the calculated driving voltage so that the ink pressure Pn at the nozzle holes 21*a* will be an appropriate value. As a result, the CPU 71 maintains a negative pressure so that the ink I will not drip from the nozzle holes 21*a* of the liquid ejecting head 20 and that the nozzle holes 21*a* will not suck air bubbles, thereby maintaining meniscuses Me. Here, as one example, the upper limit of the target value is represented by P1H, and the lower limit of the target value is represented by P1L.

The CPU 71 determines whether the ink pressure Pn at the nozzle holes 21*a* is within an appropriate range, that is, whether the ink pressure Pn at the nozzle holes 21*a* is P1L or greater and is P1H or less in Act 28. When the ink pressure Pn at the nozzle holes 21*a* is outside the appropriate range (the determination is No in Act 28), the CPU 71 advances the processing to Act 29 and determines whether the ink pressure Pn at the nozzle holes 21*a* is at the upper limit of the target value P1H or greater.

The ink pressure at the nozzle holes 21*a* of the liquid ejecting head 20 is increased when the driving force of the first circulating pump 33 is relatively strong, and decreased when the driving force of the second circulating pump 36 is relatively strong.

The CPU 71 further determines whether the driving voltage is in an adjustable range of each of the circulating pumps 33 and 36 (Act 30 and Act 33). When the driving voltage exceeds the maximum adjustable value Vmax of the circulating pump 33 or 36, the CPU 71 increases or decreases the ink pressure by using the other circulating pump 36 or 33.

Specifically, when the ink pressure Pn at the nozzle holes 21*a* is outside the appropriate range (the determination is No in Act 28) and is less than the upper limit of the target value P1H (the determination is No in Act 29), that is, when the ink pressure Pn at the nozzle holes 21*a* is less than the lower limit of the target value P1L, the CPU 71 advances the processing to Act 30 and determines whether a driving voltage V+ for pressurizing the first circulating pump 33 is the maximum adjustable value Vmax or greater, that is, whether it exceeds the adjustable range of the first circulating pump 33. When the driving voltage V+ for pressurizing the first circulating pump 33 is the maximum adjustable value Vmax or greater (the determination is Yes in Act 30), the CPU 71 advances the processing to Act 31 and increases the ink pressure by lowering the driving voltage of the second circulating pump 36. Otherwise, when the driving voltage V+ for pressuring the first circulating pump 33 is less than the maximum adjustable value Vmax and is within the adjustable range (the determination is No in Act 30), the CPU 71 advances the processing to Act 32 and increases the ink pressure by raising the driving voltage of the first circulating pump 33.

When the ink pressure Pn at the nozzle holes 21*a* is at the upper limit of the target value P1H or greater in Act 29 (the determination is Yes in Act 29), the CPU 71 advances the processing to Act 33 and determines whether a driving voltage V− for depressurizing the second circulating pump 36 is the maximum adjustable value Vmax or greater, that is, whether it exceeds the adjustable range of the second circulating pump 36. When the driving voltage V− for depressurizing the second circulating pump 36 is the maximum adjustable value Vmax or greater (the determination is Yes in Act 33), the CPU 71 advances the processing to Act 34 and decreases the ink pressure by lowering the driving voltage of the first circulating pump 33. Otherwise, when the driving voltage V− for depressurizing the second circulating pump 36 is less than the maximum adjustable value Vmax and is within the adjustable range (the determination is No in Act 30), the CPU 71 advances the processing to Act 35 and decreases the ink pressure by raising the driving voltage of the second circulating pump 36.

The CPU 71 confirms whether the command to instruct stop of the circulation from the host control device 13 is received in Act 36. Unless the CPU 71 receives the command to instruct stop of the circulation from the host control device 13, the CPU 71 determines No in Act 36 and returns the processing to Act 25. Thus, the CPU 71 repeats feedback control processing from Act 25 to Act 35 until receiving the instruction to stop the circulation in Act 36. When receiving the command to instruct stop of the circulation from the host control device 13 (the determination is Yes in Act 36), the CPU 71 closes the on-off valve 37*c* of the intermediate tank 32 to tightly close the intermediate tank 32 (Act 37). Furthermore, the CPU 71 stops driving of the first circulating pump 33 and the second circulating pump 36 to finish the circulation processing (Act 38).

In the ink jet recorder 1 according to the embodiment, the circulator 30 starts the second driving pulse in n_min milliseconds after the first driving pulse starts. Thus, the phase of the first driving pulse differs from the phase of the second driving pulse by n_min milliseconds. The first driving pulse and the second driving pulse having this particular phase difference allows the pulses, which are generated from the first circulating pump 33 and the second circulating pump 36 that are respectively driven by the first driving pulse and the second driving pulse, to cancel each other's voltage fluctuations. Accordingly, fluctuations in the ink pressure in the liquid ejecting head 20 is reduced.

In the ink jet recorder 1 according to the embodiment, the circulator 30 determines the phase difference n_min in the phase difference determination mode. That is, the circulator 30 variously varies the difference n between the phase of the first driving pulse and the phase of the second driving pulse in the phase difference determination mode. Then, the fluctuation value that represents the range of fluctuations in the pressure in the liquid ejecting head 20 is calculated for each difference n. The difference n when the fluctuation value is the minimum among the calculated fluctuation values is determined as the phase difference n_min.

In some cases, to cause the pulses of the first and the second circulating pumps 33 and 36 cancel each other's voltage fluctuations by differentiating the phases of the first driving pulse and the second driving pulse from each other, the first and the second circulating pumps 33 and 36 may be driven so that the phases of the first driving pulse and the second driving pulse are simply inverted to each other. To drive the first and the second circulating pumps 33 and 36 of which the first driving pulse and the second driving pulse are inverted to each other, the phase difference n_min is set at a half of a period of the driving pulses. However, the optimum phase difference is not the half of the period in many cases. This is because the pipe length between the first circulating pump 33 and the liquid ejecting head 20 is not the same as the pipe length between the second circulating pump 36 and the liquid ejecting head 20 in these cases. The difference in the pipe length can be one of factors that vary the optimum phase difference. Additionally, the condition of the circulation route 31, such as the resistance of the pipe passage, the condition of the ink I, such as the specific gravity and the viscosity of the ink I, and other various factors can also vary the optimum phase difference. Accordingly, the optimum phase difference may not the half of the period and can vary due to various factors. Thus, the circulator 30 determines the phase difference n_min that is more appropriate for reducing the fluctuations in the ink pressure by using the phase difference determination mode than by theoretical calculation or other calculation method.

In the ink jet recorder 1 according to the embodiment, the circulator 30 employs the piezoelectric pumps 60 as the circulating pumps 33 and 36, thereby having a simple structure and facilitating material selection. That is, the piezoelectric pump 60 needs no large driving source such as a motor or a solenoid and is made smaller than ordinary pumps such as diaphragm pumps, piston pumps, and tube pumps. In the case of using a tube pump, since the tube may contact the ink, a material that is unlikely to deteriorate the tube and the ink should be selected. In contrast, using the piezoelectric pump 60 allows the use of various materials. For example, according to the embodiment, liquid-contacting parts of the piezoelectric pump 60 can be made of a material having superior chemical resistance, such as SUS316L stainless steel, Polyphenylene sulfide (PPS), Polyphthalamide (PPA), or polyimide.

In the ink jet recorder 1 according to the embodiment, the liquid ejector 10 measures the pressures upstream and downstream of the liquid ejecting head 20 and feedback-controls the pressures by driving the first circulating pump 33 and the second circulating pump 36 to appropriately maintain the ink pressure at the nozzle holes 21*a*. Thus, for example, even when the performances of the pumps vary with time, appropriate pressure controlling is performed.

According to the embodiment, the first circulating pump 33 is located on the upstream side, and increases the ink pressure with increase in the voltage and decreases the ink pressure with decrease in the voltage. The second circulating pump 36 is located on the downstream side, and decreases the ink pressure with increase in the voltage and increases the ink pressure with decrease in the voltage. This configuration enables the use of the other pump when the driving voltage exceeds the adjustable range, thereby achieving high precision control. The circulator 30 includes the first circulating pump 33, the second circulating pump 36, the replenishing pump 53, the first pressure sensor 39*a*, the second pressure sensor 39*b*, the liquid level sensor 54, the control board, and other functions necessary for supplying and circulating the ink and for controlling the pressure adjustment of the ink, in a collective manner. Thus, compared with a large-size stationary circulator, the electric connection between the main body of the ink jet recorder 1 and the liquid ejector 10 can be made simple. Also, the channels such as the circulation route 31 and the supply route 52 are disposed together in the circulator 30, thereby enabling simplification of the configuration of the channels. As a result, the ink jet recorder 1 can be reduced in size and weight and produced at low cost.

In the liquid ejector 10, parts necessary for the feedback controlling are integrated on the control board. Thus, only information data that does not require very high speed responses, such as operation instruction and condition data, passes through the communication interface 73, and therefore, a necessary data transfer rate for the communication interface 73 is decreased.

The example embodiment described above may be modified as below.

Figure 8:
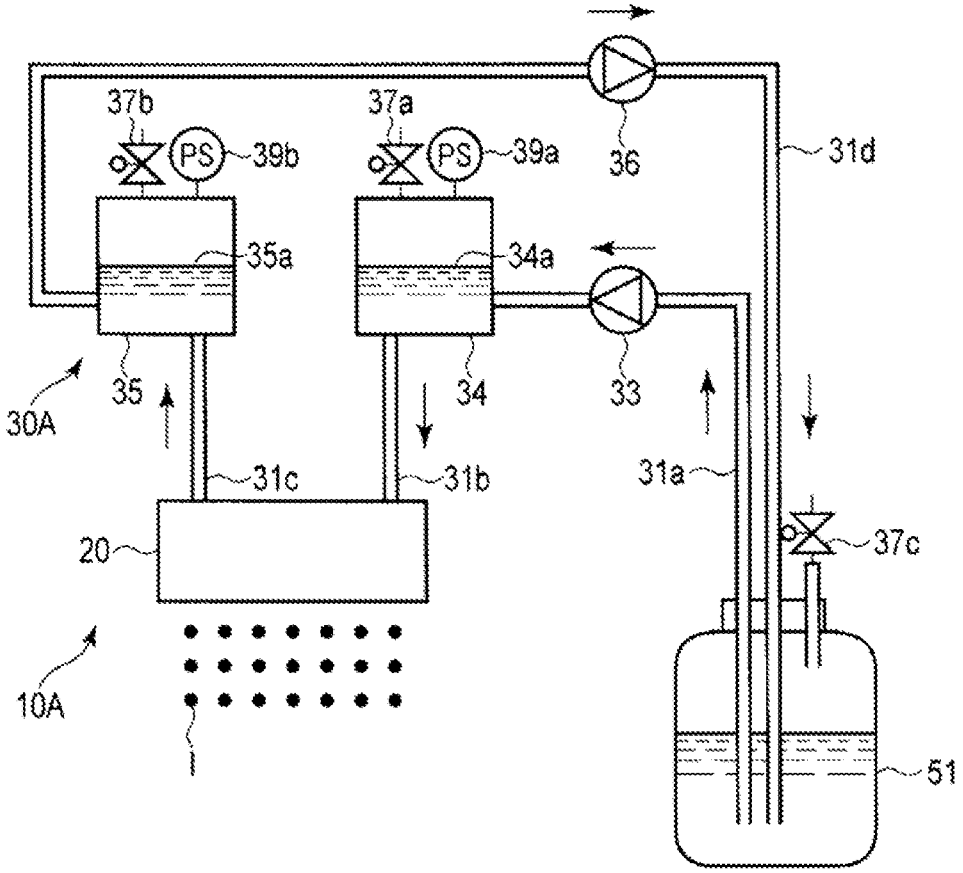
FIG. 8 is a diagram of a liquid ejector.

The liquid ejector 10 may not be provided with the intermediate tank 32. Hereinafter, a liquid ejector 10A without the intermediate tank 32 will be described with reference to FIG. 8. FIG. 8 is an explanatory diagram showing a configuration of the liquid ejector 10A. The liquid ejector 10A has a similar configuration to the liquid ejector 10 in the above-described example embodiment except that the intermediate tank 32 is not provided. The same reference numerals are used for the components that are substantially the same as those of the above-described example embodiment, and the description of repeated components may be omitted.

As shown in FIG. 8, the liquid ejector 10A has the cartridge 51, which is capable of being open to the atmosphere, in the circulation route 31 between the upstream tank 34 and the downstream tank 35. The cartridge 51 also functions as the intermediate tank. The cartridge 51 may be open to the atmosphere at any time. Effects similar to those in the liquid ejector 10 of the above-described example embodiment can be obtained in the liquid ejector 10A. Using the cartridge 51 also as the intermediate tank enables simplification of the configuration.

In the above-described example embodiment, the air pressure in the upstream tank 34 is measured to indirectly measure the pressure in the second channel 31*b*. However, the liquid ejector 10 may have another configuration that can measure the pressure in the second channel 31*b*. For example, the upstream tank 34 may not be provided. Instead of the upstream tank 34 and the first pressure sensor 39*a*, for example, a pressure sensor that can measure the pressure of liquid may be provided in the second channel 31*b*. This pressure sensor measures the pressure in the second channel 31*b*. Similarly, the liquid ejector 10 may not be provided with the downstream tank 35. As in the case of the second channel 31*b*, the liquid ejector 10 may include, for example, a pressure sensor that can measure the pressure of liquid to measure the pressure in the third channel 31*c* instead of the downstream tank 35 and the second pressure sensor 39*b*.

The first circulating pump 33 may be formed of a group of pumps. This structure provides a high liquid-sending capacity compared with a case of forming the first circulating pump 33 by one pump. Also, the second circulating pump 36 may be formed of a group of pumps. This structure provides a high liquid-sending capacity compared with a case of forming the second circulating pump 36 by one pump. When at least one of the first circulating pump 33 and the second circulating pump 36 is formed of a group of pumps, three of the pumps of the first circulating pump 33 and the second circulating pump 36 are examples of first to third pumps. The first to the third pumps include at least one used as the first circulating pump 33 and at least one used as the second circulating pump 36.

When numerically calculating the phase difference, the calculation may be complicated as the number of the pumps increases. In contrast, determining the phase difference in the phase difference determination mode, the labor for determining the phase difference is not greatly increased even when the number of the pumps is increased.

In addition to the first circulating pump 33 and the second circulating pump 36, a circulating pump (hereinafter referred to as a "third circulating pump") may also be provided in the circulation route 31. In this case, the first driving pulse and the second driving pulse are generated as to have a phase difference therebetween (hereinafter referred to a "first phase difference"), and a driving pulse of the third circulating pump (hereinafter referred to as a "third driving pulse") and the first driving pulse may also be generated as to have a phase difference therebetween (hereinafter referred to as a "second phase difference"). Under this condition, for example, the circulator 30 calculates a fluctuation value D by variously changing the combination of the first phase difference and the second phase difference in the phase difference determination mode to determine a combination of the phase differences, by which the pressure fluctuations is reduced. Moreover, multiple circulating pumps may also be provided in the circulation route 31. In this case, also, the circulator 30 determines a combination of the phase differences as described above.

The configuration of the circulator 30 of each of the embodiments described above is not limited. For example, the liquid ejectors 10 and 10A can eject liquid other than the ink. The liquid to be ejected by the liquid ejector may be dispersion such as suspension. The liquid ejector for ejecting liquid other than the ink may be, for example, a unit that ejects liquid containing conductive particles for forming wiring patterns of a printed wiring board. In another case, the liquid ejector for ejecting liquid other than the ink may be, for example, a device that ejects liquid containing cells and other components for artificially producing a tissue or an organ.

As an alternative to the above-described structure, for example, the liquid ejecting head 20 may have a structure for ejecting the ink droplets ID by deforming a vibration plate with static electricity, or a structure for ejecting the ink droplets ID from the nozzle holes 21*a* by using thermal energy from a heater or other unit.

Although each of the liquid ejectors 10 and 10A of the above-described embodiments is employed in the inkjet recorder 1, each of the liquid ejectors 10 and 10A can be employed in other device. Each of the liquid ejectors 10 and 10A can also be used in a device such as a 3D printer, an industrial manufacturing machine, or a medical device, whereby the device can be reduced in size and weight and produced at low cost.

The first circulating pump 33, the second circulating pump 36, and the replenishing pump 53 may include pumps such as tube pumps, diaphragm pumps, or piston pumps, instead of the piezoelectric pumps 60.

In the above-described embodiment, the first circulating pump 33, the second circulating pump 36, and the replenishing pump 53 are operated by AC voltage. However, the first circulating pump 33, the second circulating pump 36, and the replenishing pump 53 may be pumps that are operated by DC voltage. As in the case of AC voltage, DC voltage having pulses of rectified alternating current varies periodically with time and has a frequency other than zero. Thus, even when the first driving pulse and the second driving pulse are DC voltage, they have a phase difference therebetween. Additionally, even when the first driving pulse and the second driving pulse are direct currents that do not vary periodically with time (i.e., frequency of 0 Hz), the first driving pulse and the second driving pulse that are started at different timings from each other can be considered to have a phase difference therebetween corresponding to the difference between their start timings.

In the above example embodiment, the piezoelectric pump 60 sends liquid at a frequency equivalent to the frequency of the applied voltage. However, some kinds of pumps send liquid at a frequency that is different from the frequency of applied voltage. The circulator 30 may include these pumps that send liquid at a frequency different from the frequency of applied voltage as the first circulating pump 33, the second circulating pump 36, and the replenishing pump 35. In this case, also, the circulator 30 of the above-described example embodiment reduces fluctuations in the ink pressure. Some kinds of pumps generate a continuous flow. The circulator 30 may include these pumps that generate a continuous flow as the first circulating pump 33, the second circulating pump 36, and the replenishing pump 53. Even the pumps that generate a continuous flow can vary the pressure of the ink due to fluctuations in the magnitude of applied voltage or due to other factors. Nevertheless, the circulator 30 of the above-described example embodiment using the pumps that generate a continuous flow reduces the fluctuations in the ink pressure.

In the above-described example embodiment, the ink jet recorder 1 causes the second driving pulse be generated after the first driving pulse is generated. However, the ink jet recorder 1 may cause the first driving pulse be generated after the second driving pulse is generated. This corresponds to exchanging the processing in Act 2 with the processing in Act 4 shown in FIG. 6 and exchanging the processing in Act 21 with the processing in Act 23 shown in FIG. 7.

In the above example embodiment, the ink jet recorder 1 includes the liquid ejectors 10. However, the ink jet recorder 1 need not include the multiple liquid ejectors 10 but may include only one liquid ejector 10.

The circulator 30 may not have the phase difference determination mode. In this case, the phase difference n_min is set at a predetermined time, for example, a half of the frequency of the driving pulse. Alternatively, the phase difference n_min is set at a theoretical value that is calculated based on the pipe length and other factors. The circulator 30 having the phase difference determination mode may also use the phase difference n_min that is set at a predetermined time, for example, a half of the period of the driving pulse, or at a theoretical value. Even when the phase difference n_min is set as described above, fluctuations in the pressure of the liquid in the liquid ejecting head 20 is reduced more than when the phase difference is zero.

In the above-described example embodiment, the CPU 71 repeats the processing from Act 2 to Act 9 until the value of the variable i becomes the repetition number k or greater, that is, k times. However, the CPU 71 may determine whether to end the repetition of the processing from Act 2 to Act 9, by using other method. For example, the CPU 71 ends the repetition when the variable n exceeds 1 period. In another example, the CPU ends the repetition when the variable n exceeds a predetermined value other than 1. In yet another example, the CPU 71 ends the repetition when the fluctuation value is changed from decrease to increase. That is, the CPU 71 ends the repetition when D[i−1] is less than D[i−2] and D[i] is greater than D[i−1]. Determining whether to end the repetition as described above enables determining a suitable phase difference n_min with a less repetition number in some cases.

The initial value of the variable n may not be zero. For example, the initial value of the variable n is set at a value near a previously determined phase difference n_min or at a value near a theoretical value of the phase difference n_min. Such a setting method enables determining a suitable phase difference n_min with a less repetition number.

To obtain a minimum value of the fluctuation value, various algorithms may be used for solving an optimization problem. Using the algorithms for solving the optimization problem enables determining a suitable phase difference n_min with a time less than when the processing from Act 2 to Act 9 is simply repeated by setting the pitch width dt at a constant value. Whereas the value of the phase difference n_min is limited to an integral multiple of the pitch width dt in the above-described example embodiment, many algorithms can also use values other than an integral multiple of the pitch width dt for the phase difference n_min. Thus, using various algorithms enables calculating a value of the phase difference n_min that is closer to the optimum value.

The circulator 30 may determine the value of the phase difference n_min after receiving the instruction to start the circulation. That is, the CPU 71 may perform the processing from Act 1 to Act 11 in FIG. 6 before performing the processing in Act 21 in FIG. 7.

The circulator 30 of the above-described example embodiment can also be applied to a device other than the ink jet recorder.

The circulator 30 of the above-described example embodiment can also be used for circulating fluid such as gas instead of liquid.

An operation example of the circulator 30 according to the embodiment will be described. This example is not intended to limit the scope of the disclosure.

The circulator 30 is configured to apply an AC driving pulse with a frequency of 200 Hz to the piezoelectric pump. Thus, the piezoelectric actuator of the piezoelectric pump vibrates at a frequency of 200 Hz. The AC driving pulse with a frequency of 200 Hz has a period of 5 ms. In this circulator, fluctuations in surface pressure at the nozzle plate in the liquid ejecting head were measured by setting the phase difference (amount of phase shift) at 0, 2, 3, 4, or 5 ms. The results of this measurement are shown in FIG. 9.

Figure 9:
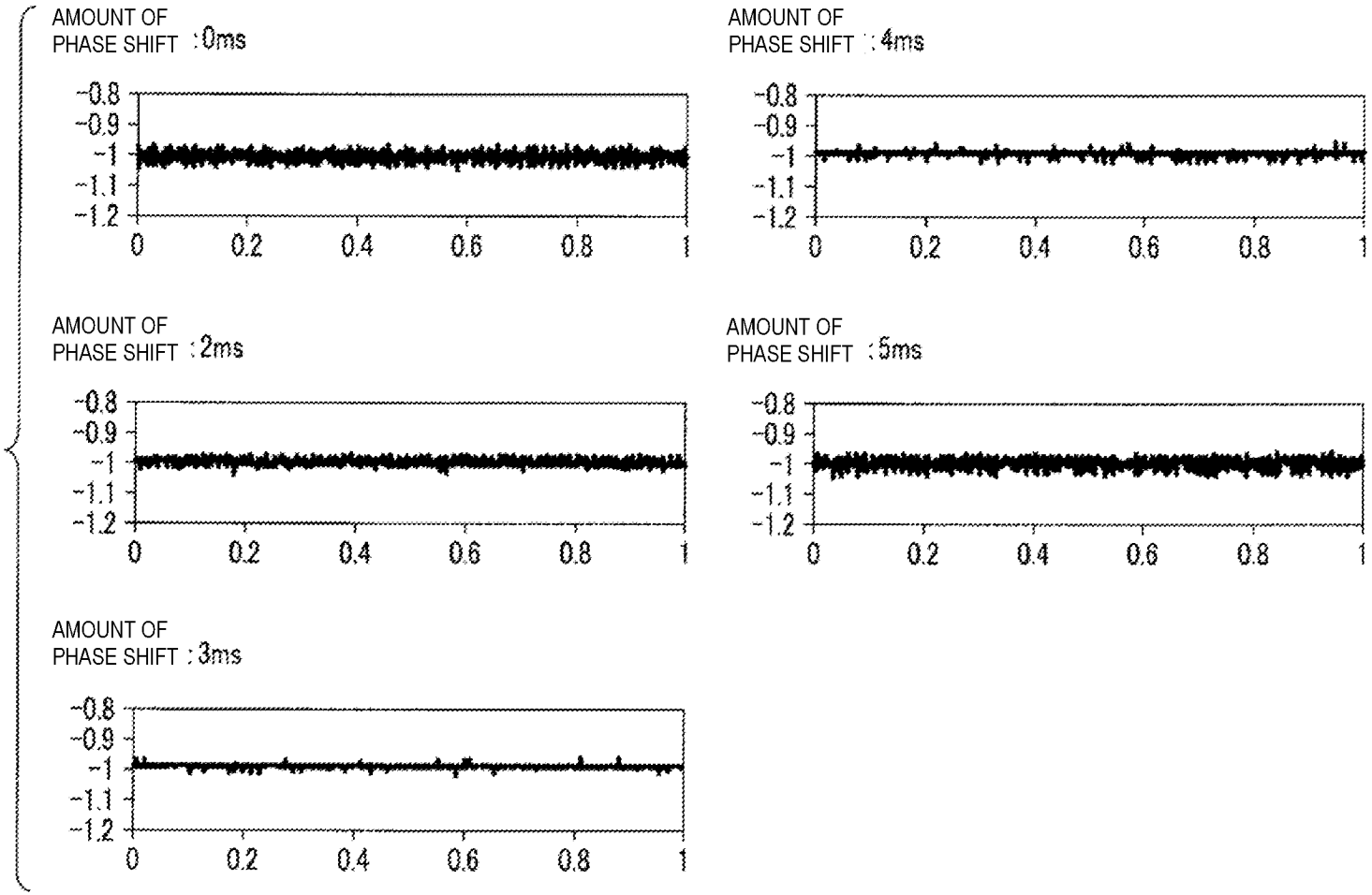
FIG. 9 depicts measurement results of an example circulator.

As shown in FIG. 9, the fluctuations in the surface pressure at the nozzle plate are the smallest when the amount of the phase shift is 3 ms, among the results of the measurement. Moreover, as shown in FIG. 9, the fluctuations in the surface pressure at the nozzle plate are smaller when the amount of the phase shift is 4 ms than when the amount of the phase shift is 2 ms. Thus, the appropriate amount of the phase shift to achieve minimum fluctuations in the surface pressure at the nozzle plate is in a range of 3 to 4 ms. This reveals that the fluctuations are not minimum when the phases of two piezoelectric pumps are inverted to each other, that is, when the amount of the phase shift is set at a half of the period (2.5 ms), in some cases.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid circulator, comprising:
an upstream tank having a first pressure sensor;
a downstream tank having a second pressure sensor;
an intermediate tank connected to the upstream tank and the downstream tank via a circulation route for circulating liquid through an liquid ejecting head, the downstream tank, the intermediate tank, and the upstream tank;
a first pump on the circulation route between the intermediate tank and the upstream tank;
a second pump on the circulation route between the downstream tank and the intermediate tank;
a first drive circuit configured to apply a first driving pulse to the first pump;
a second drive circuit configured to apply a second driving pulse to the second pump;
a controlling unit configured to:
calculate a pressure fluctuation value of the circulation route based on pressure values measured by the first pressure sensor and the second pressure sensor; and
adjust a phase difference between the first driving pulse and the second driving pulse as to minimize the pressure fluctuation value, wherein
the first driving pulse and the second driving pulse are alternating current (AC) pulses.

2. The liquid circulator according to claim 1, wherein the controlling unit is configured to, when adjusting the phase difference:
change a value of the phase difference between the first driving pulse and the second driving pulse at a predetermined interval for a predetermined number of times;
calculate a pressure fluctuation value for each value of the phase difference;
determine a value of the phase difference corresponding to a minimum fluctuation value among the calculated fluctuation values as an optimum phase difference; and
set the optimum phase difference as the phase difference between the first driving pulse and the second driving pulse.

3. The liquid circulator according to claim 1, wherein the first and the second pumps are piezoelectric pumps.

4. The liquid circulator according to claim 1, further comprising:
a cartridge for storing liquid and including a chamber which is open to the atmosphere;
a supply route via which the cartridge is fluidly connected to the intermediate tank; and
a replenishing pump on the supply route outside of the circulation route, wherein
the controlling unit is configured to drive the replenishing pump to:
send liquid to the intermediate tank when a liquid level of the intermediate tank is lower than a first predetermined level, and
stop sending liquid to the intermediate tank when the liquid level of the intermediate tank is higher than a second predetermined level.

5. The liquid circulator according to claim 1, wherein the intermediate tank is a cartridge including a chamber which is open to the atmosphere.

6. The liquid circulator according to claim 1, further comprising:
a first diaphragm at a liquid surface of the upstream tank; and
a second diaphragm at a liquid surface of the downstream tank, wherein
the first pressure sensor measures the pressure value inside the upstream tank above the first diaphragm, and
the second pressure sensor measures the pressure value inside the downstream tank above the second diaphragm.

7. A liquid circulator, comprising:
an upstream tank having a first pressure sensor;
a downstream tank having a second pressure sensor;
an intermediate tank connected to the upstream tank and the downstream tank via a circulation route for circulating liquid through an liquid ejecting head, the downstream tank, the intermediate tank, and the upstream tank;
a first pump on the circulation route between the intermediate tank and the upstream tank;
a second pump on the circulation route between the downstream tank and the intermediate tank;
a first drive circuit configured to apply a first driving pulse to the first pump;
a second drive circuit configured to apply a second driving pulse to the second pump;
a controlling unit configured to:
calculate a pressure fluctuation value of the circulation route based on pressure values measured by the first pressure sensor and the second pressure sensor; and
adjust a phase difference between the first driving pulse and the second driving pulse as to minimize the pressure fluctuation value, wherein the first driving pulse and the second driving pulse are direct current (DC) pulses applied at different timings having a difference corresponding to the adjusted phase difference.

8. A liquid ejector, comprising:

an ink ejecting head configured to eject ink onto recording medium, the ink ejecting head having a supply port for receiving ink and a recovery port for removing ink;

an upstream tank having a first pressure sensor;

a downstream tank having a second pressure sensor;

an intermediate tank connected to the upstream tank and the downstream tank via a circulation route through which ink circulates through the ink ejecting head, the downstream tank, the intermediate tank, and the upstream tank;

a first pump on the circulation route between the intermediate tank and the upstream tank;

a second pump on the circulation route between the downstream tank and the intermediate tank;

a first drive circuit configured to apply a first driving pulse to the first pump;

a second drive circuit configured to apply a second driving pulse to the second pump; and a controlling unit configured to:

calculate a pressure fluctuation value of the circulation route based on pressure values measured by the first pressure sensor and the second pressure sensor; and adjust a phase difference between the first driving pulse and the second driving pulse as to minimize the pressure fluctuation value, wherein the first driving pulse and the second driving pulse are alternating current (AC) pulses.

9. The liquid ejector according to claim 8, wherein the controlling unit is configured to, when adjusting the phase difference:

change a value of the phase difference between the first driving pulse and the second driving pulse at a predetermined interval for a predetermined number of times;

calculate a pressure fluctuation value for each value of the phase difference;

determine a value of the phase difference corresponding to a minimum fluctuation value among the calculated fluctuation values as an optimum phase difference; and set the optimum phase difference as the phase difference between the first driving pulse and the second driving pulse.

10. The liquid ejector according to claim 8, wherein the first and the second pumps are piezoelectric pumps.

11. The liquid ejector according to claim 8, further comprising:

a cartridge for storing ink and including a chamber which is open to the atmosphere;

a supply route via which the cartridge is fluidly connected to the intermediate tank; and a replenishing pump on the supply route outside of the circulation route, wherein the controlling unit is configured to drive the replenishing pump to:

send ink to the intermediate tank when a liquid level of the intermediate tank is lower than a first predetermined level, and stop sending ink to the intermediate tank when the liquid level of the intermediate tank is higher than a second predetermined level.

12. The liquid ejector according to claim 8, wherein the intermediate tank is a cartridge including a chamber which is open to the atmosphere.

13. The liquid ejector according to claim 8, further comprising:

a first diaphragm at a liquid surface of the upstream tank; and a second diaphragm at a liquid surface of the downstream tank, wherein the first pressure sensor measures the pressure value inside the upstream tank above the first diaphragm, and the second pressure sensor measures the pressure value inside the downstream tank above the second diaphragm.

14. A liquid ejector, comprising:

an ink ejecting head configured to eject ink onto recording medium, the ink ejecting head having a supply port for receiving ink and a recovery port for removing ink;

an upstream tank having a first pressure sensor;

a downstream tank having a second pressure sensor;

an intermediate tank connected to the upstream tank and the downstream tank via a circulation route through which ink circulates through the ink ejecting head, the downstream tank, the intermediate tank, and the upstream tank;

a first pump on the circulation route between the intermediate tank and the upstream tank;

a second pump on the circulation route between the downstream tank and the intermediate tank;

a first drive circuit configured to apply a first driving pulse to the first pump;

a second drive circuit configured to apply a second driving pulse to the second pump; and a controlling unit configured to:

calculate a pressure fluctuation value of the circulation route based on pressure values measured by the first pressure sensor and the second pressure sensor; and adjust a phase difference between the first driving pulse and the second driving pulse as to minimize the pressure fluctuation value, wherein the first driving pulse and the second driving pulse are direct current (DC) pulses applied at different timings having a difference corresponding to the adjusted phase difference.

15. A method for circulating liquid on a circulation route, comprising:

measuring a first pressure value in an upstream tank;

measuring a second pressure value in a downstream tank;

applying a first driving pulse to a first pump to move liquid along a portion of a circulation route between an intermediate tank and the upstream tank;

applying a second driving pulse to a second pump to move liquid along a portion of the circulation route between the downstream tank and the intermediate tank;

calculating a pressure fluctuation value of the liquid in the circulation route based on the first pressure value and the second pressure value; and adjusting a phase difference between the first driving pulse and the second driving pulse to minimize the pressure fluctuation value, wherein the first driving pulse and the second driving pulse are alternating current (AC) pulses.

16. The method for circulating liquid on a circulation route according to claim 15, wherein adjusting the phase difference comprises:

changing a value of the phase difference between the first driving pulse and the second driving pulse at a predetermined interval for a predetermined number of times;

calculating a pressure fluctuation value for each value of the phase difference;

determining a value of the phase difference corresponding to a minimum fluctuation value among the calculated fluctuation values as an optimum phase difference; and setting the optimum phase difference as the phase difference between the first driving pulse and the second driving pulse.

17. A method for circulating liquid on a circulation route, comprising:

measuring a first pressure value in an upstream tank;

measuring a second pressure value in a downstream tank;

applying a first driving pulse to a first pump to move liquid along a portion of a circulation route between an intermediate tank and the upstream tank;

applying a second driving pulse to a second pump to move liquid along a portion of the circulation route between the downstream tank and the intermediate tank;

calculating a pressure fluctuation value of the liquid in the circulation route based on the first pressure value and the second pressure value; and adjusting a phase difference between the first driving pulse and the second driving pulse to minimize the pressure fluctuation value, wherein the first driving pulse and the second driving pulse are direct current (DC) pulses applied at different timings having a difference corresponding to the adjusted phase difference.

* * * * *